US011652319B2

(12) United States Patent
Pepe et al.

(10) Patent No.: US 11,652,319 B2
(45) Date of Patent: May 16, 2023

(54) TWO-WIRE PLUG AND RECEPTACLE

(71) Applicant: COMMSCOPE TECHNOLOGIES LLC, Hickory, NC (US)

(72) Inventors: Paul John Pepe, Clemmons, NC (US); Allan Nielsen, Galten (DK)

(73) Assignee: CommScope Technologies LLC, Hickory, NC (US)

( * ) Notice: Subject to any disclaimer, the term of this patent is extended or adjusted under 35 U.S.C. 154(b) by 823 days.

(21) Appl. No.: 16/081,595

(22) PCT Filed: Mar. 3, 2017

(86) PCT No.: PCT/US2017/020756
§ 371 (c)(1),
(2) Date: Aug. 31, 2018

(87) PCT Pub. No.: WO2017/152108
PCT Pub. Date: Sep. 8, 2017

(65) Prior Publication Data

US 2021/0194179 A1 Jun. 24, 2021

Related U.S. Application Data

(60) Provisional application No. 62/303,959, filed on Mar. 4, 2016.

(30) Foreign Application Priority Data

Jun. 8, 2016 (GB) ..... 1610050

(51) Int. Cl.
*H01R 13/62* (2006.01)
*H01R 13/627* (2006.01)
(Continued)

(52) U.S. Cl.
CPC ..... *H01R 13/6275* (2013.01); *H01R 13/6278* (2013.01); *H01R 13/6683* (2013.01); *H01R 13/7175* (2013.01); *H01R 2103/00* (2013.01)

(58) Field of Classification Search
CPC ..... H01R 2107/00; H01R 13/6683; H01R 13/6205; H01R 13/665; H01R 2103/00;
(Continued)

(56) References Cited

U.S. PATENT DOCUMENTS 2,673,968 A 3/1954 Smith
2,813,257 A 11/1957 Cornell, Jr.
(Continued)

FOREIGN PATENT DOCUMENTS

CN 1408135 A 4/2003
CN 102055115 A 5/2011
(Continued)

OTHER PUBLICATIONS

European Examination Report for Application No. 17760934.4 dated Mar. 5, 2021.
(Continued)

*Primary Examiner* — Truc T Nguyen
(74) *Attorney, Agent, or Firm* — Merchant & Gould P.C.

(57) ABSTRACT

A plug includes a body portion as well as first and second electrical strip contacts. The body portion has a length, an upper surface and a lower surface. The first electrical strip contact is proximate the upper surface of the body portion and has a length substantially equal to or less than the length of the body portion. The second electrical strip contact is proximate the lower surface of the body portion and has a length substantially equal to or less than the length of the body portion.

18 Claims, 9 Drawing Sheets

(51) Int. Cl.
*H01R 13/66* (2006.01)
*H01R 13/717* (2006.01)
*H01R 103/00* (2006.01)

(58) Field of Classification Search
CPC .. H01R 24/60; H01R 13/2428; H01R 13/447; H01R 13/506; H01R 13/6272; H01R 13/6315; H01R 13/64; H01R 13/642; H01R 13/6581; H01R 13/6582; H01R 13/6658; H01R 13/6691; H01R 2201/16; H01R 24/76; H01R 24/78; H01R 24/86; H01R 25/006; H01R 31/005; H01R 31/06; H01R 33/90; H01R 43/20; H01R 43/24; H01R 12/714; H01R 12/718; H01R 12/778; H01R 13/04; H01R 13/08; H01R 13/2407; H01R 13/2421; H01R 13/2435; H01R 13/2442; H01R 13/2471; H01R 13/2478; H01R 13/405; H01R 13/41; H01R 13/42; H01R 13/426; H01R 13/428; H01R 13/434; H01R 13/4365; H01R 13/46; H01R 13/5025; H01R 13/508; H01R 13/5205; H01R 13/521; H01R 13/625; H01R 13/6271; H01R 13/629; H01R 13/62927; H01R 13/635; H01R 13/639; H01R 13/641; H01R 13/6471; H01R 13/658; H01R 13/6591; H01R 13/6592; H01R 13/6594; H01R 13/6608; H01R 13/703; H01R 13/7038; H01R 13/73; H01R 2105/00; H01R 2201/26; H01R 24/28; H01R 24/30; H01R 24/38; H01R 24/40; H01R 24/58; H01R 24/64; H01R 25/142; H01R 27/00; H01R 29/00; H01R 31/065; H01R 33/205; H01R 35/04; H01R 43/16; H01R 4/2406; H01R 9/05; H01R 9/0518; H01R 9/26

See application file for complete search history.

(56) References Cited

U.S. PATENT DOCUMENTS 3,199,060 A 8/1965 Marasco
3,827,007 A 7/1974 Fairbairn et al.
3,828,706 A 8/1974 Scott
4,054,350 A 10/1977 Hardesty
4,449,767 A 5/1984 Weidler
4,458,971 A 7/1984 D'Urso et al.
4,565,416 A 1/1986 Rudy et al.
4,702,538 A 10/1987 Hutter et al.
4,743,208 A 5/1988 Weisenburger
4,744,774 A 5/1988 Pauza
4,824,394 A 4/1989 Roath et al.
4,917,625 A 4/1990 Haile
4,932,906 A 6/1990 Kaley et al.
5,013,255 A 5/1991 Juret et al.
5,014,407 A 5/1991 Boughten et al.
5,240,436 A 8/1993 Bradley et al.
5,368,499 A 11/1994 Hirt
5,385,476 A 1/1995 Jasper
5,442,243 A 8/1995 Bailey
5,496,184 A 3/1996 Garrett et al.
5,533,915 A 7/1996 Deans
5,580,264 A 12/1996 Aoyama et al.
5,748,819 A 5/1998 Szentesi et al.
5,749,755 A 5/1998 Genta et al.
5,833,496 A 11/1998 Hollander et al.
5,897,404 A 4/1999 Goodman et al.
5,915,989 A 6/1999 Adriaenssens et al.
5,984,703 A * 11/1999 Weingartner ..... H01R 24/76 439/544
5,989,057 A 11/1999 Gerke et al.
6,019,521 A 2/2000 Manning et al.
6,045,389 A 4/2000 Ferrill et al.
6,050,845 A 4/2000 Smalley, Jr. et al.
6,065,994 A 5/2000 Hashim et al.
6,135,804 A 10/2000 Lux
6,217,230 B1 4/2001 Matsushita
6,254,440 B1 7/2001 Ko et al.
6,270,372 B1 8/2001 Jenner et al.
6,280,230 B1 8/2001 Takase et al.
6,305,950 B1 10/2001 Doorhy
6,390,687 B1 5/2002 Shirakawa
6,402,571 B1 6/2002 Muller et al.
6,488,550 B1 12/2002 Kikuchi et al.
6,499,889 B1 12/2002 Shirakawa et al.
6,568,967 B2 5/2003 Inaba et al.
6,572,276 B1 6/2003 Theis et al.
6,641,431 B2 11/2003 Saitoh
6,702,617 B1 3/2004 Clement et al.
6,729,901 B2 5/2004 Aekins
6,805,577 B2 10/2004 Murakami et al.
7,004,797 B2 2/2006 Harada et al.
7,201,601 B2 4/2007 Lappohn
7,217,162 B2 5/2007 Harada et al.
7,278,854 B1 * 10/2007 Robinette ..... H01R 24/58 439/63
7,291,046 B2 11/2007 Russelburg
7,325,976 B2 2/2008 Gurreri et al.
7,537,393 B2 5/2009 Anderson et al.
7,559,789 B2 7/2009 Hashim
7,559,805 B1 7/2009 Yi et al.
7,618,297 B2 11/2009 Wang
7,867,033 B2 1/2011 Kumagai et al.
7,955,112 B2 * 6/2011 Yang ..... H05K 1/18 439/328
8,052,482 B1 11/2011 Lin
8,109,789 B2 2/2012 Tyler
8,113,889 B2 2/2012 Zhang et al.
8,172,468 B2 5/2012 Jones et al.
8,303,337 B2 11/2012 Ballard et al.
8,684,763 B2 4/2014 Mattson et al.
8,690,596 B2 4/2014 Su et al.
8,715,016 B2 5/2014 DeBock et al.
8,757,895 B2 6/2014 Petersen
8,840,424 B2 9/2014 Kudo
8,888,535 B2 11/2014 Knight et al.
8,911,260 B2 * 12/2014 Golko ..... H01R 13/6581 439/108
8,915,759 B2 12/2014 Miyamoto
8,979,572 B2 3/2015 Mochizuki
8,979,574 B2 3/2015 Daily, Jr. et al.
8,987,933 B2 3/2015 Yu
9,093,807 B2 7/2015 O'Connor et al.
9,136,652 B2 9/2015 Ngo
9,172,169 B2 10/2015 Hagio et al.
9,209,578 B2 12/2015 Mochizuki
9,293,877 B2 3/2016 Wong et al.
9,343,822 B2 5/2016 Sparrowhawk et al.
9,356,439 B2 5/2016 Keith et al.
9,490,591 B2 11/2016 Yamashita et al.
9,590,339 B2 3/2017 Oberski et al.
9,634,417 B2 4/2017 Ramanna et al.
9,685,726 B2 6/2017 Ang et al.
9,692,161 B2 6/2017 Lindkamp et al.
9,799,981 B2 10/2017 Weber
9,853,388 B2 12/2017 Copper et al.
9,917,390 B1 3/2018 Bianca et al.
9,972,932 B2 5/2018 Copper et al.
10,061,090 B2 8/2018 Coenegracht
10,069,269 B2 9/2018 Takahashi
10,164,383 B2 12/2018 Feng
10,389,062 B2 8/2019 Zebhauser et al.
10,403,996 B2 * 9/2019 Pan ..... H01M 50/296
10,411,409 B2 9/2019 Hashim et al.
10,665,974 B2 5/2020 Oberski et al.
10,665,985 B2 5/2020 Keith et al.
10,727,626 B2 7/2020 Murray
10,768,374 B2 9/2020 Gurreri et al.
10,998,685 B2 5/2021 Curtis et al.

(56) References Cited

U.S. PATENT DOCUMENTS

| | | | | |
|---|---|---|---|---|
| 11,031,719 | B2 | 6/2021 | Somanathapura Ramanna | |
| 11,271,350 | B2 | 3/2022 | Moffitt et al. | |
| 11,362,463 | B2 | 6/2022 | Tobey et al. | |
| 2001/0018287 | A1 | 8/2001 | Reichle | |
| 2002/0055294 | A1 | 5/2002 | Murakami et al. | |
| 2002/0072275 | A1 | 6/2002 | Arai | |
| 2004/0152360 | A1 | 8/2004 | Harris et al. | |
| 2005/0227545 | A1 | 10/2005 | Lahoreau et al. | |
| 2005/0232566 | A1 | 10/2005 | Rapp et al. | |
| 2006/0134966 | A1 | 6/2006 | Lappohn | |
| 2006/0286872 | A1 | 12/2006 | Margulis et al. | |
| 2007/0270043 | A1 | 11/2007 | Pepe et al. | |
| 2007/0287332 | A1 | 12/2007 | Gordon et al. | |
| 2008/0057793 | A1 | 3/2008 | Gerber et al. | |
| 2009/0176415 | A1 | 7/2009 | AbuGhazaleh et al. | |
| 2010/0003863 | A1 | 1/2010 | Siemon et al. | |
| 2010/0035454 | A1 | 2/2010 | Morgan et al. | |
| 2010/0040332 | A1 | 2/2010 | Van Den Meersschaut et al. | |
| 2010/0041273 | A1* | 2/2010 | Scherer | H01R 13/6597 439/607.01 |
| 2010/0120284 | A1 | 5/2010 | Oka et al. | |
| 2010/0173528 | A1 | 7/2010 | Martich et al. | |
| 2010/0221951 | A1 | 9/2010 | Pepe et al. | |
| 2010/0304600 | A1 | 12/2010 | Busse | |
| 2010/0319963 | A1 | 12/2010 | James et al. | |
| 2011/0143602 | A1* | 6/2011 | Niitsu | H05K 3/32 439/660 |
| 2011/0294342 | A1 | 12/2011 | DeBock et al. | |
| 2012/0004655 | A1 | 1/2012 | Kim et al. | |
| 2012/0204417 | A1 | 8/2012 | Stull | |
| 2013/0075149 | A1* | 3/2013 | Golko | H01R 13/658 174/359 |
| 2013/0095702 | A1* | 4/2013 | Golko | H01R 27/00 439/676 |
| 2013/0171885 | A1 | 7/2013 | Zhang | |
| 2013/0252469 | A1 | 9/2013 | Mochizuki | |
| 2014/0038462 | A1 | 2/2014 | Coffey et al. | |
| 2014/0127936 | A1 | 5/2014 | Leroyer et al. | |
| 2014/0213119 | A1* | 7/2014 | Thackston | H01R 24/62 439/676 |
| 2014/0273584 | A1 | 9/2014 | Sun et al. | |
| 2015/0083455 | A1 | 3/2015 | Keith et al. | |
| 2015/0155670 | A1 | 6/2015 | Gardner | |
| 2015/0207254 | A1* | 7/2015 | Kamei | H05K 3/4015 174/257 |
| 2015/0214667 | A1 | 7/2015 | Chen et al. | |
| 2015/0249295 | A1 | 9/2015 | Tseng | |
| 2016/0028198 | A1 | 1/2016 | Yamashita et al. | |
| 2016/0093984 | A1 | 3/2016 | Iwamoto | |
| 2016/0131858 | A1 | 5/2016 | Anderson et al. | |
| 2016/0164223 | A1* | 6/2016 | Zebhauser | H01R 13/582 439/660 |
| 2016/0192527 | A1 | 6/2016 | Anderson et al. | |
| 2016/0294111 | A1* | 10/2016 | Kobayashi | H01R 12/716 |
| 2016/0315436 | A1 | 10/2016 | Plamondon et al. | |
| 2017/0077966 | A1 | 3/2017 | Chen et al. | |
| 2017/0184798 | A1 | 6/2017 | Coenegracht | |
| 2017/0207561 | A1 | 7/2017 | Scherer et al. | |
| 2017/0264025 | A1 | 9/2017 | Lappöhn | |
| 2017/0373405 | A1 | 12/2017 | Lappoehn | |
| 2019/0154923 | A1 | 5/2019 | Flaig | |
| 2019/0296491 | A1 | 9/2019 | Maesoba et al. | |
| 2020/0036130 | A1 | 1/2020 | Fontaine et al. | |
| 2020/0106216 | A1 | 4/2020 | Hashim et al. | |
| 2020/0153174 | A1* | 5/2020 | Curtis | H01R 4/184 |
| 2020/0274273 | A1 | 8/2020 | Oberski et al. | |
| 2020/0350730 | A1 | 11/2020 | Keith et al. | |
| 2021/0083441 | A1 | 3/2021 | Moffitt et al. | |
| 2021/0104842 | A1 | 4/2021 | Keith et al. | |
| 2021/0104843 | A1 | 4/2021 | Tobey et al. | |
| 2021/0151905 | A1 | 5/2021 | Novak et al. | |
| 2021/0378834 | A1* | 12/2021 | Kleiner | A61F 2/30771 |
| 2022/0158389 | A1 | 5/2022 | Pepe et al. | |

FOREIGN PATENT DOCUMENTS

| | | | |
|---|---|---|---|
| CN | 102136649 | A | 7/2011 |
| CN | 104428958 | A | 3/2015 |
| CN | 106415944 | A | 2/2017 |
| CN | 107104329 | A | 2/2017 |
| CN | 209167592 | U | 7/2019 |
| DE | 102 16 915 | A1 | 10/2003 |
| EP | 1 128 494 | A2 | 8/2001 |
| EP | 1 385 232 | A2 | 1/2004 |
| EP | 1 783 871 | A1 | 5/2007 |
| EP | 2 393 169 | A1 | 12/2011 |
| EP | 3 091 614 | A1 | 11/2016 |
| FR | 2 290 136 | A7 | 5/1976 |
| GB | 628419 | A2 | 8/1949 |
| GB | 2510490 | A8 | 8/2014 |
| JP | 2004-206934 | A | 7/2004 |
| JP | 4514356 | B2 | 5/2010 |
| JP | 2014-38847 | A | 2/2014 |
| KR | 10-2010-0122766 | A | 11/2010 |
| WO | 2006/048867 | A1 | 5/2006 |
| WO | 2012/103383 | A2 | 8/2012 |
| WO | 2016/132855 | A1 | 8/2016 |
| WO | 2017/019370 | A1 | 2/2017 |
| WO | 2019/165466 | A1 | 8/2019 |
| WO | 2020/051340 | A1 | 3/2020 |

OTHER PUBLICATIONS

DiBiaso et al., "Designing a Connection System for Gigabit Automotive Ethernet," SAE International Journal of Passenger Cars—Electronic and Electrical Systems, vol. 9, No. 1, pp. 134-146 (May 2016).

2-Pin Connector w/Header, .10", All Electronics Corporation, 3 pages, downloaded: http://www.allelctronics.com/item/con-242/2-pin-connector-w/header-.10/html (May 31, 2017).

2 Pin Connectors, Wiring Specialties, 5 pages (May 31, 2017).

Combined Search and Examination Report for Great Britain Patent Application No. 1610050.5 dated Nov. 7, 2016, 8 pages.

International Search Report and Written Opinion of the International Searching Authority for International Patent Application No. PCT/US2017/020756 dated Jun. 7, 2017, 16 pages.

U.S. Non-Final Office Action for U.S. Appl. No. 16/975,891 dated Aug. 25, 2021.

U.S. Final Office Action for U.S. Appl. No. 16/608,126 dated Sep. 1, 2021.

Office Action from Chinese Application No. 201980023438.2 dated Jun. 3, 2021, 19 pages [English translation].

U.S. Non-Final Office Action for U.S. Appl. No. 15/931,046 dated Jul. 19, 2021.

U.S. Non-Final Office Action for U.S. Appl. No. 16/964,730 dated Jul. 28, 2021.

U.S. Non-Final Office Action for U.S. Appl. No. 16/608,126 dated Dec. 29, 2021.

U.S. Final Office Action for U.S. Appl. No. 15/931,046 dated Jan. 19, 2022.

Extended European Search Report for corresponding European Patent Application No. 17760934.4 dated Sep. 25, 2019, 8 pages.

* cited by examiner

TWO-WIRE PLUG AND RECEPTACLE

CROSS-REFERENCE TO RELATED APPLICATIONS

This application is a National Stage of PCT/US2017/020756, filed on Mar. 3, 2017, which claims the benefit of U.S. Patent Application No. 62/303,959, filed on Mar. 4, 2016, and claims the benefit of Great Britain Patent Application No. 1610050.5, filed on Jun. 8, 2016, the disclosures of which are incorporated herein by reference in their entireties. To the extent appropriate, a claim of priority is made to each of the above disclosed applications.

FIELD OF THE INVENTION

The present disclosure generally relates to interfacing plugs and receptacles and, more particularly, to interfacing plugs and receptacles configured to be coupled relative to only two electrical contacts.

BACKGROUND OF THE DISCLOSURE

Advances are made every day in relation to the way power and data are delivered to consumers. One current advancement provides for the delivery of power and data over a single twisted wire pair, e.g., power over Ethernet (PoE). A plug and receptacle configuration to enable the delivery of power and data over a single twisted pair is needed.

SUMMARY

A first aspect of the disclosure is directed to a plug that includes a body portion as well as first and second electrical strip contacts. The body portion has a length, an upper surface and a lower surface. The first electrical strip contact is proximate the upper surface of the body portion and has a length substantially equal to or less than the length of the body portion. The second electrical strip contact is proximate the lower surface of the body portion and has a length substantially equal to or less than the length of the body portion. The noted embodiment is exemplary providing reference to upper and lower surfaces, however, any orientation of surfaces or sides, e.g., upper/lower, lower/upper, left/right, right/left, first/second, second/first, opposing, etc., is considered to be included in the disclosure.

Another aspect of the disclosure is directed to a system comprising the plug and a receptacle. The receptacle includes a housing as well as a first and second electrical strip contacts. The housing has an interior receiving cavity that is configured to receive the plug. The interior receiving cavity is defined by a length, an upper surface and a lower surface. The first electrical strip contact is proximate the upper surface of the interior receiving cavity and has a length substantially equal to or less than the length of the interior receiving cavity. The second electrical strip contact is proximate the lower surface of the interior receiving cavity and has a length substantially equal to or less than the length of the interior receiving cavity. Upon insertion of the plug into the interior receiving cavity, the first electrical strip contact of the plug is electrically coupled to the first electrical strip contact of the interior receiving cavity and the second electrical strip contact of the plug is electrically coupled to the second electrical strip contact of the interior receiving cavity. The noted embodiment is exemplary providing reference to upper and lower surfaces, however, any orientation of surfaces or sides, e.g., upper/lower, lower/upper, left/right, right/left, first/second, second/first, opposing, etc., is considered to be included in the disclosure.

The above summary is not intended to describe each embodiment or every implementation. A more complete understanding will become apparent and appreciated by referring to the following detailed description and claims in conjunction with the accompanying drawings.

DESCRIPTION OF THE DRAWINGS

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

The present disclosure is directed to interfacing plugs and receptacles that are configured to be coupled to external components relative to two electrical contacts. Such external components may include, for example, a two wire cable comprising a single twisted or non-twisted wire pair, a two-contact circuit board, a two-contact LED light bulb, a two-contact room application sensor (e.g., environment as temperature, humidity, motion, photodetector, etc.), two contact machine applications sensors (e.g., flow, pressure temperature, vibration, force), a two contact network camera, a two-contact wireless access point, any power over Ethernet (PoE) device that is to be powered by PoE using a single twisted-pair gigabit Ethernet system, etc.

Figure 1A:
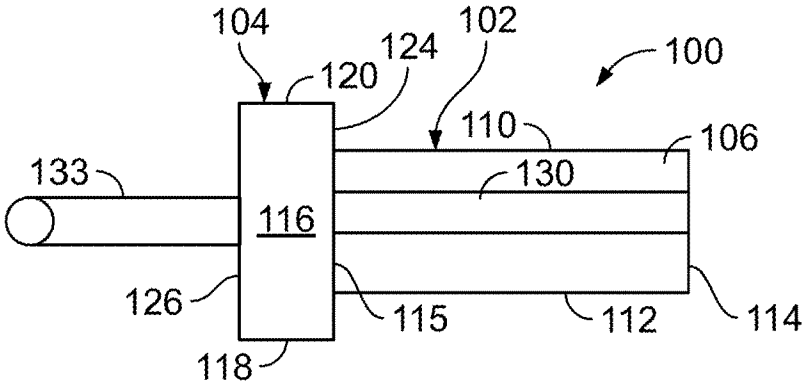
FIGS. 1A-1F illustrate the top, front and rear views of plug and a receptacle, respectively.
Figure 1B:
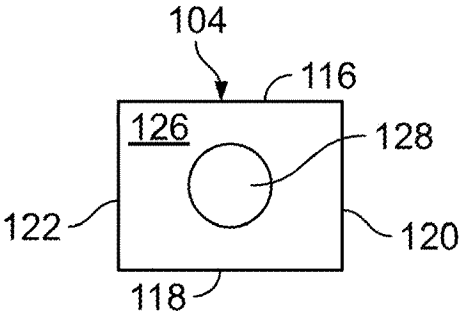
Figure 1C:
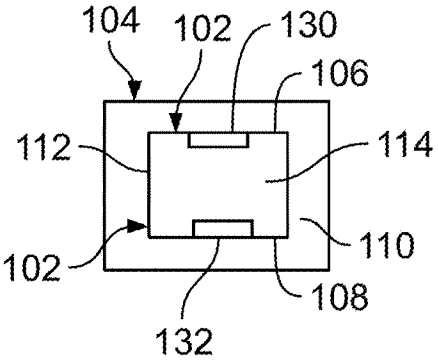

FIGS. 1A-1F illustrate an example embodiment of the interfacing plug 100 and receptacle 150. As shown in FIGS. 1A-1C, the plug 100 includes an elongate body 102 and base portion 104. The elongate body 102 is defined by an upper face 106 and a lower face 108 connected by a first side wall 110 and a second side wall 112. The elongate body 102 is further defined by front face 114 that serves to enclose the forward portion of the body 102. The rearward portion of the body 102, a rear face 115, abuts the base portion 104 of the plug 100. The base portion 104 similarly includes an upper face 116 and a lower face 118 connected by a first side wall 120 and a second side wall 122. A forward face 124 of the base portion 104 abuts the rearward portion of the body 102 while a rear face 126 of the base portion 104 operates to enclose a portion of the plug 100 while leaving an opening 128 there through and into the body 102. The upper and lower faces 106, 108 of the body 102 of the plug 100 are provided with strip contacts 130 and 132, respectively. The strip contacts 130 and 132 are configured to be electrically coupled to a two-wire cable or other two-contact device that is inserted through the opening 128 and terminated therein through known termination methods (e.g., insulation displacement connection (IDC), piercing contact, contact crimp, etc.). As such the opening 128 may be configured to accommodate a specific size cable, e.g., cable 133, or device or, alternatively, may be configured to accommodate various sizes of cables or devices for termination.

While the above-described example embodiment of the plug 100 has been described with reference to FIGS. 1A-1C as including substantially flat faces 106, 108, 116, 118 and sides 110, 112, 120, 122, it should be noted that the faces and sides need not be flat but may incorporate a concave or convex surface structure such that faces and side are still present but may alternatively be configured in a substantially rounded configuration where actual sides are no longer distinguishable. Further, the front face 114 of the body also need not have a flat configuration but may be alternatively configured, for example, as a tapered face, pointed face, concave face, convex face or other desirable configuration. In one example, embodiment, the front face 114 is configured to shape-wise mate or interface with an interior contour of the receptacle 150. Further still, the strip contacts 130, 132 are described and illustrated as being positioned opposite one another on upper face 106 and lower face 108, however, they may be alternatively positioned for example, opposite one another on first and second side walls 110, 112, respectively, or positioned on proximate face/side pairs. Additionally, the strip contacts 130, 132 may alternatively be replaced with other types of contacts, for example, button contacts, rivet contacts, tip contacts, etc. Alternatively, the strip contacts may be replaced, for example, by a printed circuit board (PCB) having a copper trace on each side, e.g., the traces acting as the contacts. Moreover, the base portion 104 of the plug 100 may have the same or larger or smaller external perimeter as that of the body 102.

Figure 1D:
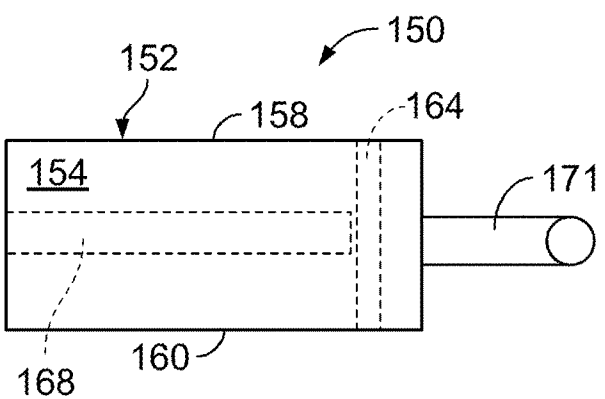
Figure 1E:
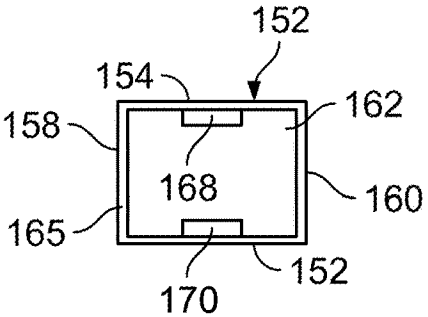
Figure 1F:
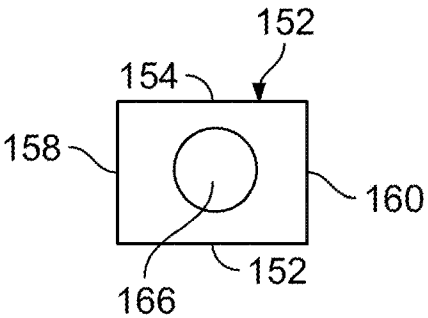

Referring now to FIGS. 1D-1F, an example embodiment of the receptacle 150 may be appreciated. As shown, the receptacle 150 is generally comprised of a housing body 152. The housing body 152 includes an upper face 154 and a lower face 156 connected by a first side wall 158 and second side wall 160. The faces 154, 156 and side walls 158, 160 define an interior receiving cavity 162. The interior receiving cavity 162 has a volume and perimeter configured to accommodate at least the body 102 of the plug 100. As such, the interior receiving cavity 162 is defined by a shape consistent with the shape of the body 102. In the example embodiment of FIG. 1, the interior receiving cavity 162 is of a rectangular, substantially flat faced configuration but may, alternatively, be configured to accommodate for example, a plug body 102 having convex or concave walls, a plug body of a circular configuration, or even of a triangular shape, etc. Further the interior receiving cavity 162 may additionally be configured with a back receiving wall 164 that is configured to shape-wise accommodate the shape configuration of the front face 114 of the body 102 of the plug 100.

In the instance where the plug 100 incorporates a base portion 104 that is of a larger perimeter than the body 102, the interior receiving cavity 162 is provided with a receiving face 165 that is configured to abut the base portion 104 of the plug 100 upon substantially complete insertion of the body 102 of the plug 100 within the interior receiving cavity 162. The housing body 152 of the receptacle 150 is additionally configured with an opening 166 opposite the interior receiving cavity 162; the back receiving wall 164 separates the opening 166 from the interior receiving cavity 162. The upper and lower faces 154, 156, within the interior receiving cavity 162, are provided with strip contacts 168, 170, respectively to directly interface and establish electric and/or magnetic coupling with the strip contacts 130 and 132 of the plug 100 when inserted within the receptacle 150. The strip contacts 168, 170 are configured to be electrically and/or magnetically coupled to a two-wire cable or other two-contact device that is inserted through the opening 166 and terminated therein through known termination methods ((e.g., insulation displacement connection (IDC), piercing contact, contact crimp, etc.). As such, the opening 166 may be configured to accommodate a specific size cable, e.g., cable 171, or device, or, alternatively, may be configured to accommodate a number of various sized cables or devices for termination.

As with plug 100, the strip contacts 168, 170 of the receptacle 150 may be positioned in opposite one another on the first and second side walls 158, 160 within the interior receiving cavity 162 rather than opposite one another via the upper and lower faces 154, 156 within the interior receiving cavity 162; or they may, alternatively, be positioned on proximate face/side pairs within the interior receiving cavity 162. Regardless, the strip contacts 168, 170 of the receptacle 150 are positioned within the interior receiving cavity 162 to directly interface with the strip contacts 130, 132 of the plug 100. Further, as with the plug 100, the strip contacts of the receptacle 150 may alternatively be replaced with other types of contacts, for example, button contacts, rivet contacts, tip contacts, etc. Alternatively, the strip contacts may be replaced, for example, by a printed circuit board (PCB) having a copper trace on each side, e.g., the traces acting as the contacts. In another example embodiment, one or more of the strip contacts 130, 132, 168, 170 of the plug 100 and receptacle 150, respectively, may be crowned convexly such that the crowning of the strip contact may be deflected upon the plug 100 being inserted into the receptacle to establish a stronger interface between the pairs of contacts (e.g., 130/168, 132/170).

The plug 100 and the receptacle 150 may be made of the same, similar or different materials. The material is generally a non-conductive material that is conducive to molding. Such materials include, for example, plastics and polymers (e.g., ABS, urea-formaldehyde, etc.).

The reception and retainment of the plug within the receptacle described above may be enhanced through use of a latching system. One example of a latching system 280 is illustrated in the plug 200 and receptacle 250 embodiments of FIGS. 2A-2B. As before, the plug 200 includes a body 202 and a base portion 204. The body 202 defined by an upper and lower face 206, 208 (not shown, see for example corresponding items in FIGS. 1A-1F) connected by first and second side walls 210, 212. The upper and lower faces 206, 208 incorporate strip contacts 230, 232, (not shown, see for example corresponding items in FIGS. 1A-1F) respectively. The receptacle 250 generally comprises a housing body 252 having an upper and a lower face 254, 256 connected by first and second side walls 258, 260. The faces 254, 256 and side walls 258, 260 define an interior receiving cavity 262. The upper and lower faces 254, 256, within the interior receiving cavity 262, are provided with strip contacts 268, 270, (not shown, see for example corresponding items in FIGS. 1A-1F) respectively The latching system 280 generally comprises a fixed beam latch latching system wherein the receptacle 250 incorporates a fixed beam 282 that is centrally positioned within each of the side walls 258, 260, respectively. Each of the fixed beams 282 has a first end 284 and a second end 286 supported by the side walls 258, 260, such that maximum deflection of each of the beams 282 is provided in the center of the beam 282. Within the interior receiving cavity 262, each of the fixed beams 282 is provided with a rounded protrusion 288 configured to operate as a latch retaining feature; the protrusion 288 may be unitary to the fixed beam 282 or an independent element secured to the fixed beam 282. Further, each of the fixed beams 282 may, themselves, be unitary with the side walls 258, 260 or may be independent elements secured to the side walls 258, 260.

Figure 2A:
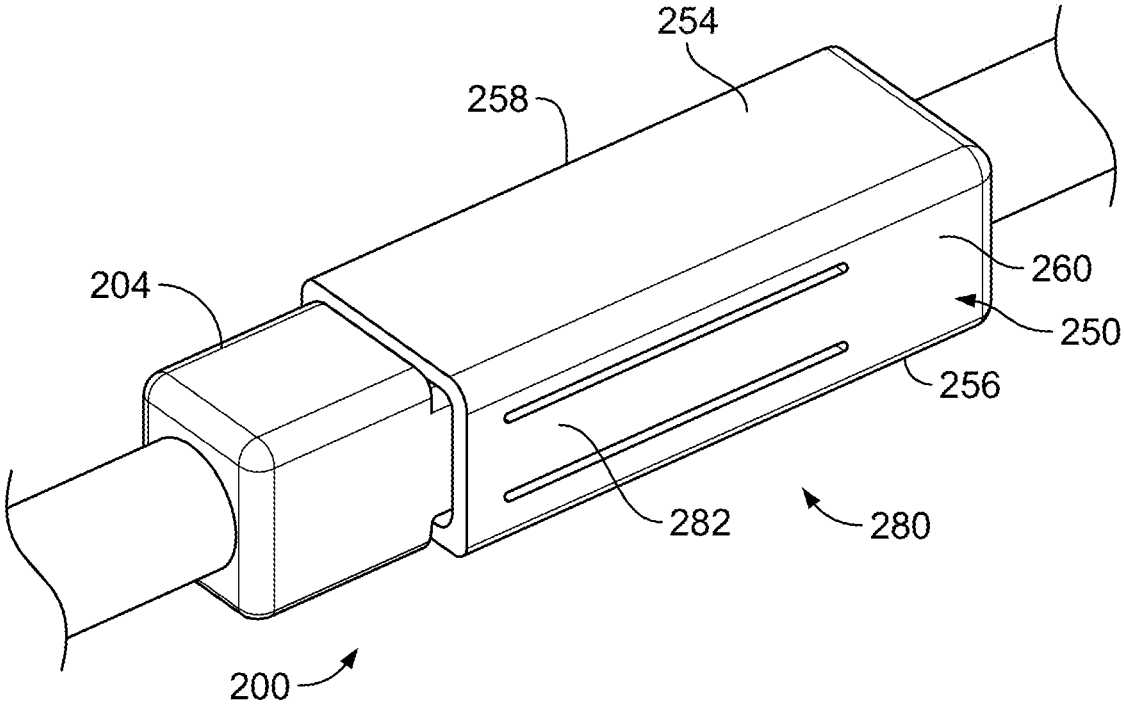
FIGS. 2A-2B provide a perspective view of a latching system of a plug and receptacle.
Figure 2B:
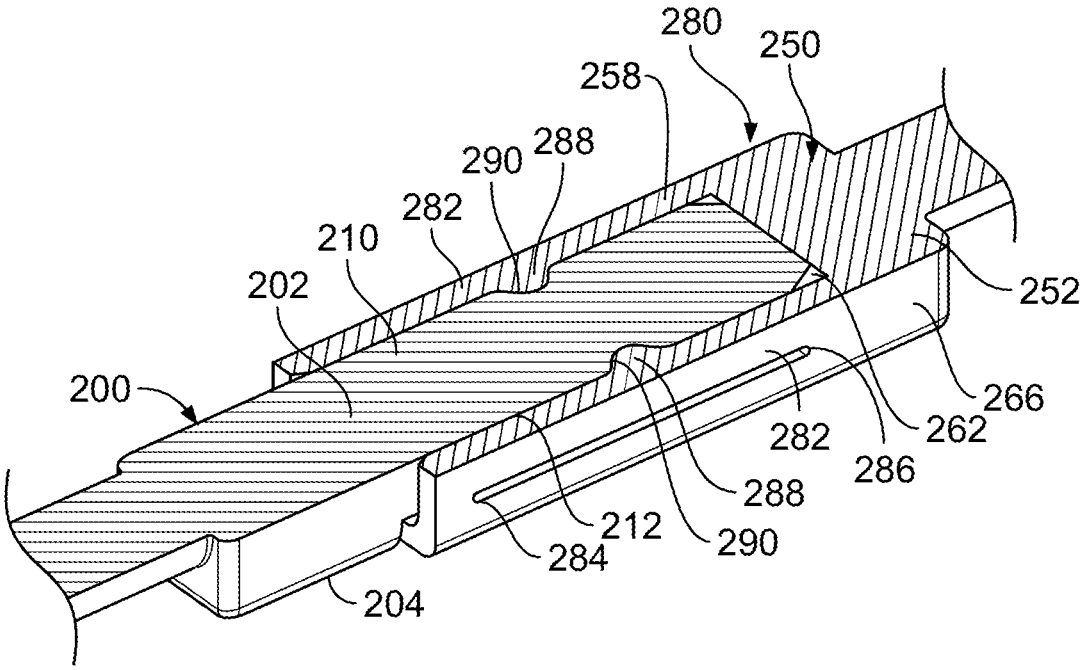

In the latching system 280, each of the first and second side walls 210, 212 of the plug 200 incorporates a receiving cavity 290. In the embodiment of FIGS. 2A-2B, each of the receiving cavities 290 spans the full height of the side walls 210, 212. Alternatively, for example, each of the receiving cavities 290 may span only a portion of the height of the side walls 210, 212. Each of the receiving cavities 290 is configured to mechanically interface with the latch retaining features, e.g., the rounded protrusions 288, of the receptacle 250. When the plug 200 is inserted into the receptacle 250, with some insertion force, each of the fixed beams 282 deflects outward, e.g., away from the interior receiving cavity 262, until the plug 200 is fully in position. Once the plug 200 is in position, mechanical and electrical contact is established between strip contacts 230, 232 and strip contacts 268, 270. Further, each of the deflected fixed beams 282 has returned to its original, un-deflected position. Accordingly, the plug 200 and the receptacle 250 require a pull out force to undo the internal latching that has occurred between the protrusions 288 and the receiving cavities 290.

Figure 3A:
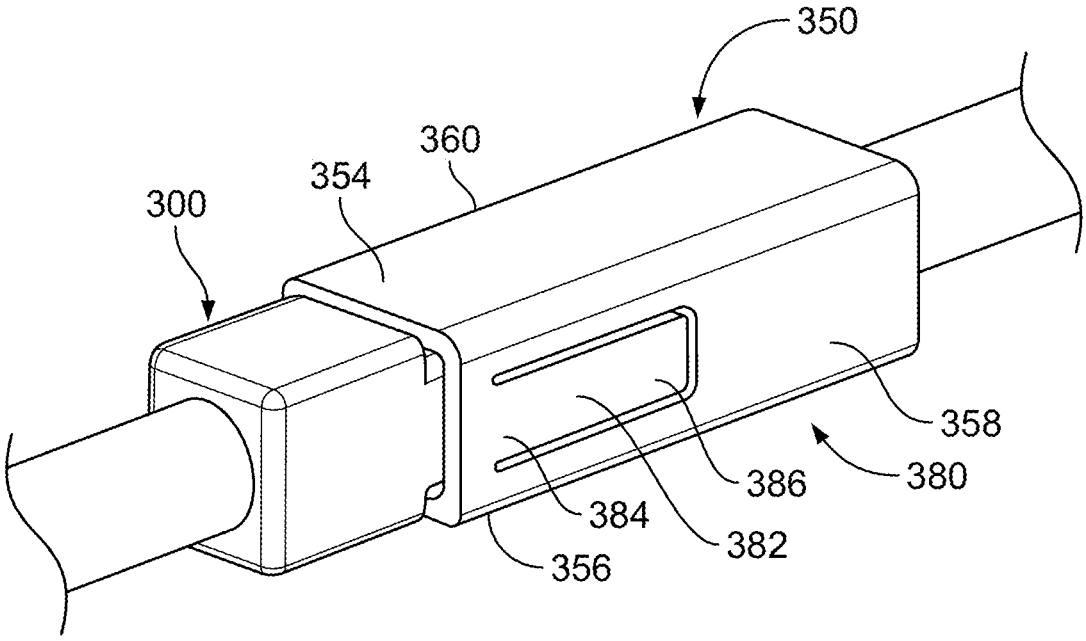
FIGS. 3A-3B provide a perspective view of a latching system of a plug and receptacle.
Figure 3B:
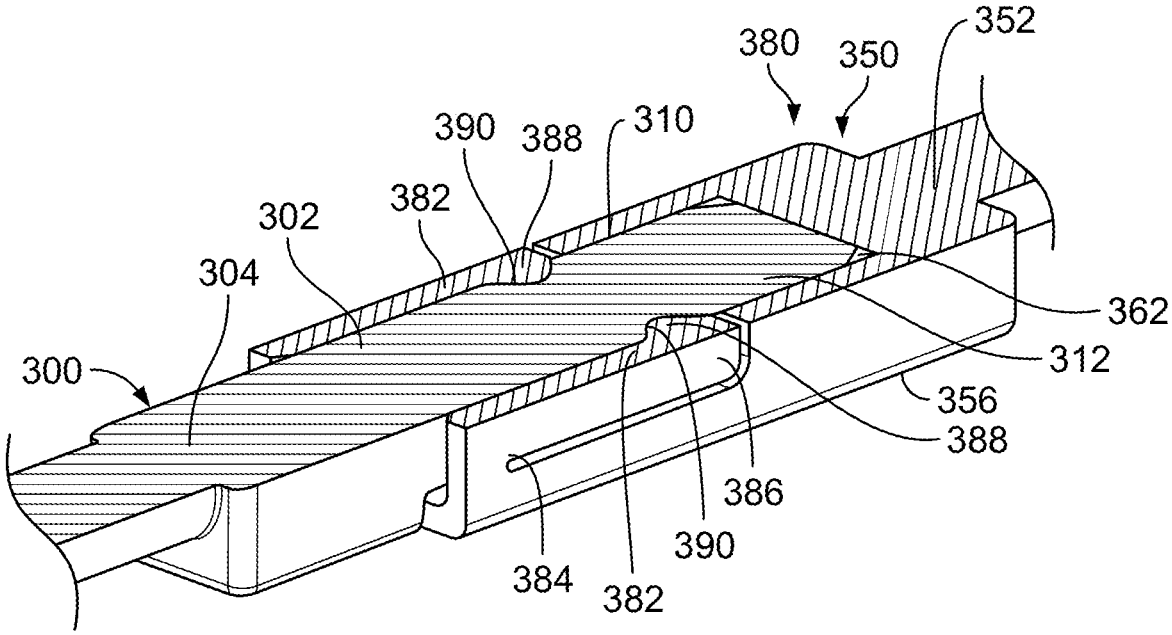

Another example of a latching system 380 is illustrated in the plug 300 and receptacle 350 embodiments of FIGS. 3A-3B. As before, the plug 300 includes a body 302 and a base portion 304. The body 302 defined by an upper and lower face 306, 308 (not shown, see for example corresponding items in FIGS. 1A-1F) connected by first and second side walls 310, 312. The upper and lower faces 306, 308 incorporate strip contacts 330, 332, (not shown, see for example corresponding items in FIGS. 1A-1F) respectively. The receptacle 350 generally comprises a housing body 352 having an upper and a lower face 354, 356 connected by first and second side walls 358, 360. The faces 354, 356 and side walls 358, 360 define an interior receiving cavity 362. The upper and lower faces 354, 356, within the interior receiving cavity 362, are provided with strip contacts 368, 370, (not shown, see for example corresponding items in FIGS. 1A-1F) respectively The latching system 380 generally comprises a cantilevered beam latch latching system wherein each of the side walls 358, 360 of the receptacle 350 incorporates a cantilevered beam 382. Each of the cantilevered beams 382 is supported at a first end 384 by the side walls 358, 360 while a second end 386 of each of the cantilevered beams 382 is free or unsupported. Accordingly, the maximum deflection of the cantilevered beam is provided at the free, second end 386. Each of the cantilevered beams 382 incorporates a rounded protrusion 388 that is configured to operate as a latch retaining feature. The protrusion 388 may be unitary to the cantilevered beam 382 or an independent element secured to the cantilevered beam 382. Further, each of the cantilevered beams 382 may, themselves, be unitary with the side walls 358, 360 at the secured first end 384, or may be independent elements secured to the side walls 358, 360 at the secured first end 384.

In the latching system 380, each of the first and second side walls 310, 312 of the plug 300 incorporates a receiving cavity 390. In the embodiment of FIGS. 3A-3B, each of the receiving cavities 390 spans the full height of the side walls 310, 312. Alternatively, for example, each of the receiving cavities 390 may span only a portion of the height of the side walls 310, 312. Each of the receiving cavities 390 is configured to mechanically interface with the latch retaining features, e.g., the rounded protrusions 388, of the receptacle 350. When the plug 300 is inserted into the receptacle 350, with some insertion force, each of the cantilevered beams 382 deflects outward, e.g., away from the interior receiving cavity 360, until the plug 300 is fully in position. Once the plug 300 is in position, mechanical and electrical contact is established between strip contacts 330, 332 and strip contacts 368, 370. Further, each of the deflected cantilevered beams 382 has returned to its original, un-deflected position. Accordingly, the plug 300 and the receptacle 350 require a pull out force to undo the internal latching that has occurred between the protrusions 388 and the receiving cavities 390.

Another example of a latching system 480 is illustrated in the plug 400 and receptacle 450 embodiments of FIGS. 4A-4D. As before, the plug 400 includes a body 402 and a base portion 404. The body 402 defined by an upper and lower face 406, 408 connected by first and second side walls 410, 412. The upper and lower faces 406, 408 incorporate strip contacts 430, 432 (not shown), respectively. The receptacle 450 generally comprises a housing body 452 having an upper and a lower face 454, 456 connected by first and second side walls 458, 460. The faces 454, 456 and side walls 458, 460 define an interior receiving cavity 462. The upper and lower faces 454, 456, within the interior receiving cavity 462, are provided with strip contacts 468, 470, respectively.

Figure 4B:
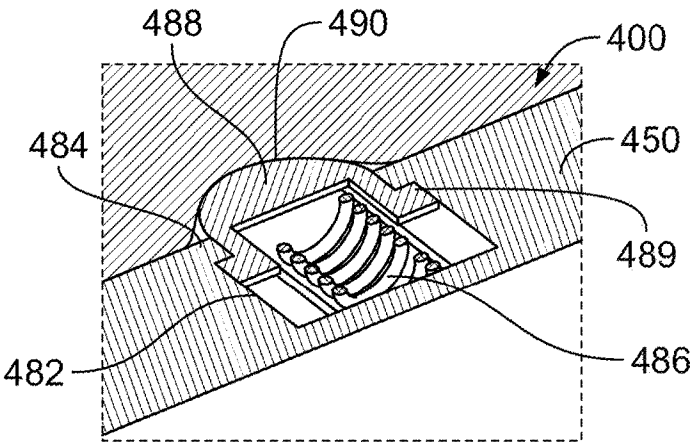
FIGS. 4A-4D provide a perspective view of a latching system of a plug and receptacle.
Figure 4A:
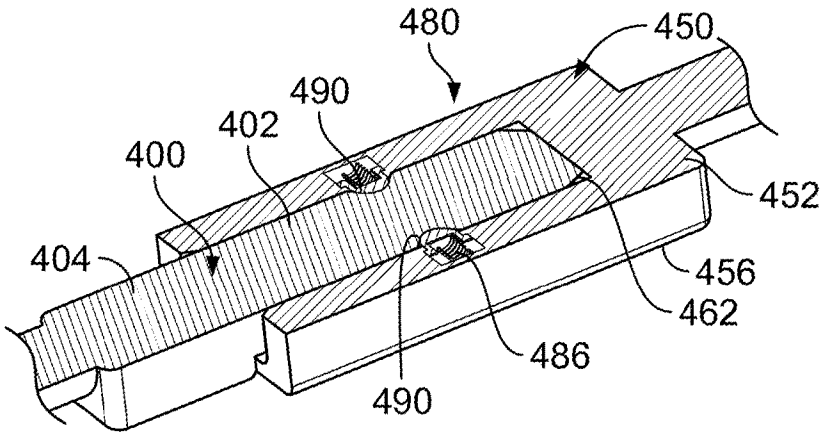
Figure 4D:
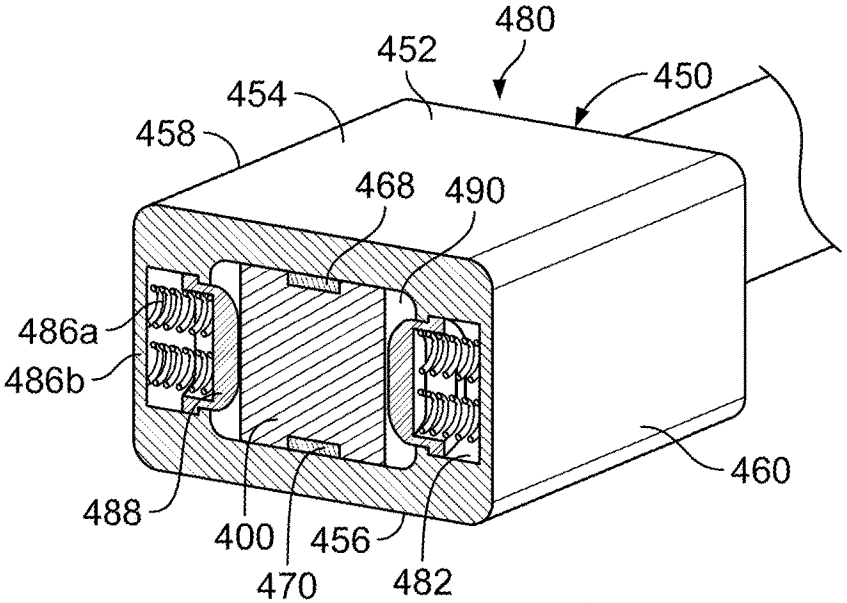
Figure 4C:
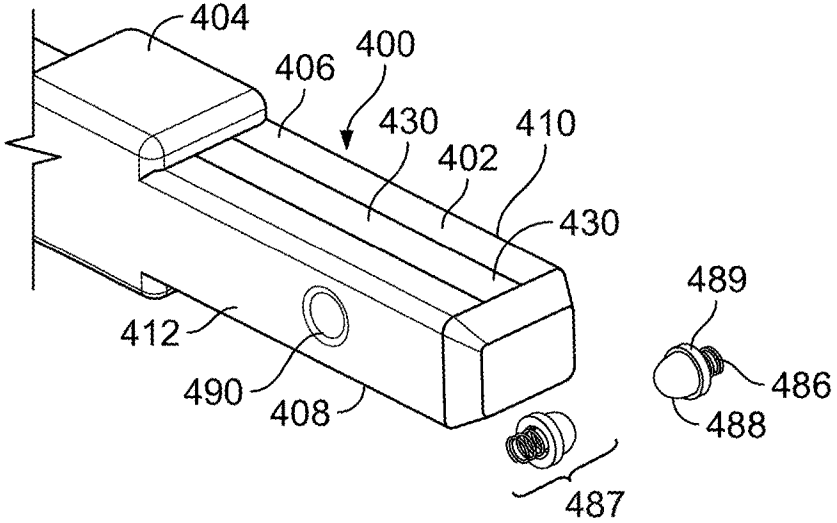

The latching system 480 generally comprises a spring-loaded plunger latching system wherein each of the side walls 458, 460, within the interior receiving cavity 462 of the receptacle 450, incorporates a recess 482 having a narrowed neck portion 484. The recess 482 is configured to house a spring 486 and contain the movement of a rounded protrusion 488, whose movement towards the interior receiving cavity 462 is encouraged by the tension within the spring 486. A flange 489 extends outward from the rounded protrusion 488 and operates to limit the travel of the protrusion by abutting the narrowed neck portion 484 of the recess 482 at full extension. The protrusion 488 and the spring 486 together form a plunger latch 487 which operates as a latch retaining feature. FIG. 4D provides a variation on the embodiment of FIGS. 4A-4C wherein the protrusion 488 is provided in an elongate configuration and the movement of the protrusion occurs relative to a pair of springs 486*a*, 486*b* housed within each recess 482.

In the latching system 480, each of the first and second side walls 410, 412 of the plug 400 incorporates a receiving cavity 490. In the embodiments of FIGS. 4A, 4B and 4D, each of the receiving cavities 490 spans the full height of the side walls 410, 412. Alternatively, for example, each of the receiving cavities 490 may span only a portion of the height of the side walls 410, 412, see FIG. 4C. Each of the receiving cavities 490 is configured to mechanically interface with the latch retaining features, e.g., the plunger latches 487, of the receptacle 450. When the plug 400 is inserted into the receptacle 450, with some insertion force, each of the ball plunger latches deflects outward, e.g., away from the interior receiving cavity 462, until the plug 400 is fully in position. Once the plug 400 is in position, mechanical and electrical contact is established between strip contacts 430, 432 and strip contacts 468, 470. Further, each of the plunger latches 487 has returned to its original, un-deflected position. Accordingly, the plug 400 and the receptacle 450 require a pull out force to undo the internal latching that has occurred between the protrusions 488 of the plunger latches 487 and the receiving cavities 490.

Figure 5:
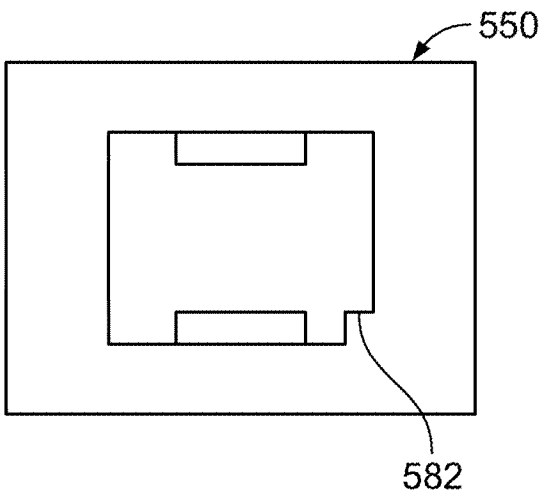
FIG. 5 provides a perspective view of a keying feature of a plug and receptacle.

Various other features and configurations may be incorporated into and/or realized by the plug and receptacle of the present disclosure. For example, with reference to FIG. 5, the plug 500 and receptacle 550 are configured with a complementary keying feature. The keying feature provides for a protrusion 580 within the receptacle 550 that corresponds to a receiving void 582 on the plug 500. Alternatively, the protrusion may reside on the plug with the receiving void within the receptacle. The keying feature ensures alignment of the plug 500 and receptacle 550, and enables the plug 500 to be inserted into the receptacle in only one orientation. Other keying configurations between the plug 500 and the receptacle 550 may also be employed without departing from the spirit or scope of the disclosure.

Figure 7:
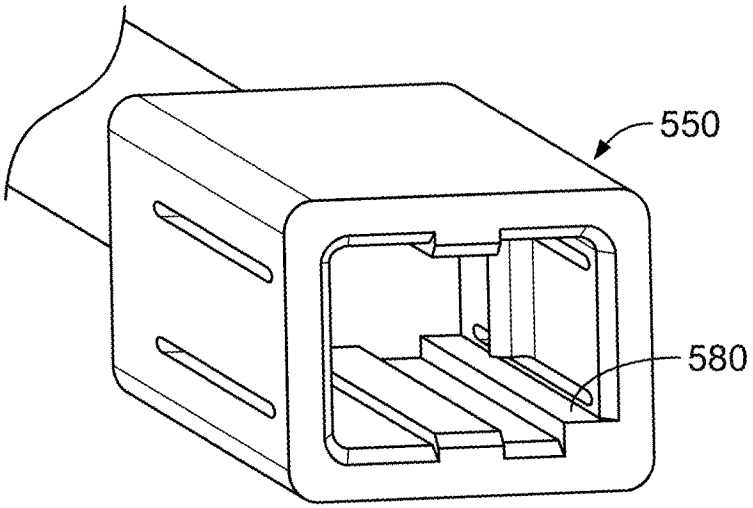
FIG. 7 illustrates an array of receptacles.
Figure 7:
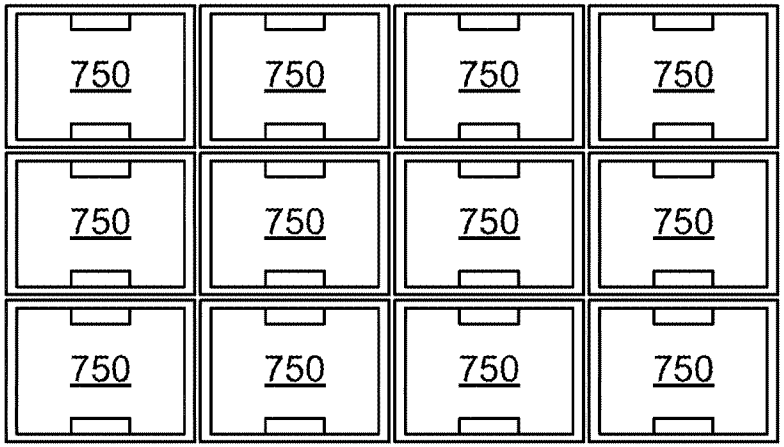
Figure 6:
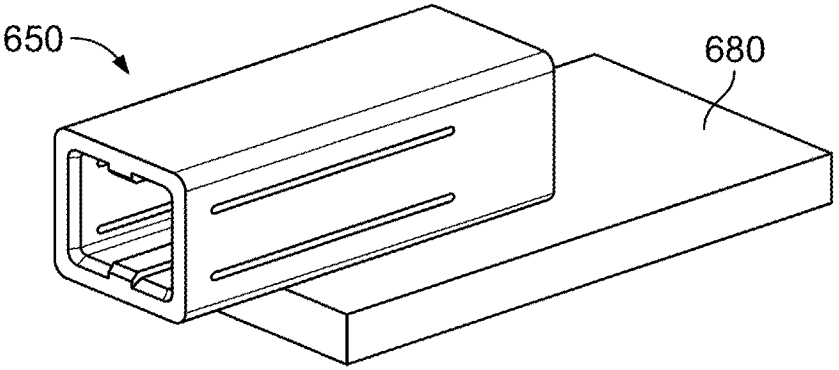
FIG. 6 is a perspective view of a circuit board mounting of a receptacle.

The plugs and receptacles of the present disclosure may be configured for various applications beyond those described above. For example, FIG. 6 illustrates an example embodiment where receptacle 650 (or plug) is configured for mounting on a printed circuit board 680. In still another example embodiment, see FIG. 7, a plurality of receptacles 750 (and/or plugs) may be combined to form a row, column, or combined column/row structure. Thus, the plugs and receptacle may be free floating or contained within a panel providing a panel array or cluster for bulk connections.

Figure 8:
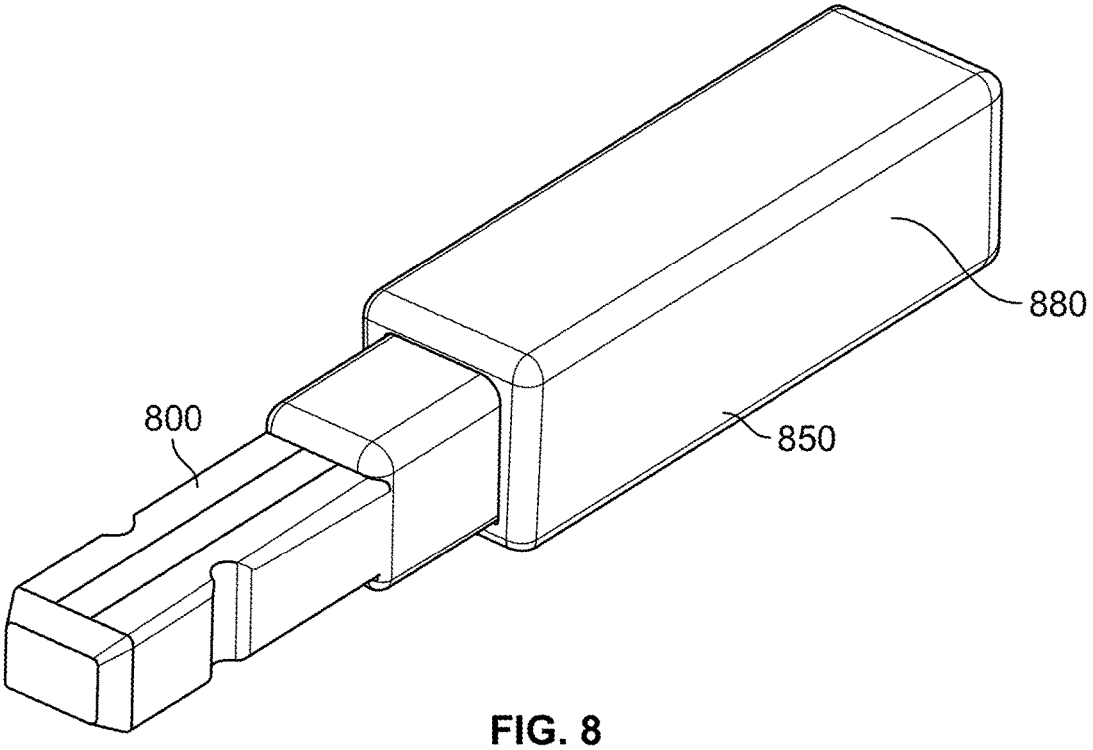
FIG. 8 illustrates a plug and receptacle configuration wherein the receptacle is directly coupled to or incorporates therein a powered device.

FIG. 8 illustrates an example embodiment of a plug 800 and receptacle 850 wherein the receptacle 850 incorporates within or is connected directly to a device 880, for example, an LED light bulb, a room application sensor (e.g., environment as temperature, humidity, motion, photodetector, etc.), a machine application sensor (e.g., flow, pressure temperature, vibration, force), a network camera, a wireless access point, any power over Ethernet (PoE) device that is to be powered by PoE using a single twisted-pair gigabit Ethernet system, etc. In still other example embodiments, the plug 800 itself may incorporate a printed circuit board (PCB) presenting a copper trace in place of, or in addition to, one or both strip contacts as a mechanical and/or electrical interface.

Figure 9:
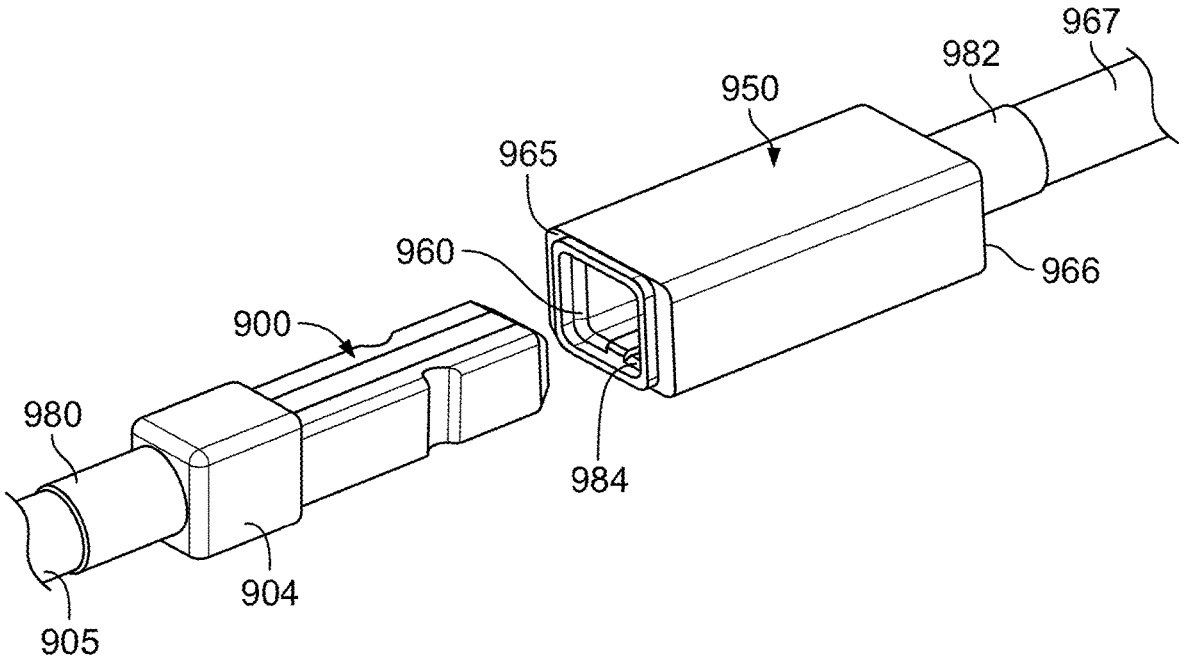
FIG. 9 is perspective view of a plug and receptacle with a sealing feature.

FIG. 9 illustrates an example embodiment where the plug 900 and the receptacle 950 have been configured for a harsh environment, e.g., an environment where the plug and receptacle are exposed to dust, moisture or other contaminants that may damage or destroy the connectivity interface between contacts. More specifically, the plug 900 is provided with a gasket 980, or other type of sealing device, between the base portion 904 of the plug 900 and the cable 905 (or device) that is received through the base portion 904 of the plug 900. The receptacle 950 is similarly provided with a gasket 982, or other type of sealing device, between the opening 966 of the receptacle 950 and the cable 967 (or device) that is received through the opening 966 of the receptacle. The receptacle 950 is additionally provided with a gasket 984, or other type of sealing device, to provide a seal between the base portion 904 of the plug 900 and the opening to the interior receiving cavity 960 at the receiving face 965 of the receptacle 950. This embodiment may additionally include an ingress protection (IP) code or rating indicating the level of protection provided by the gaskets. Including the above-described protections against environmental elements make the plug 900 and the receptacle 950 particularly well-suited to automotive applications, communication networks, manufacturing areas, industrial areas, as well as medical areas.

Figure 10:
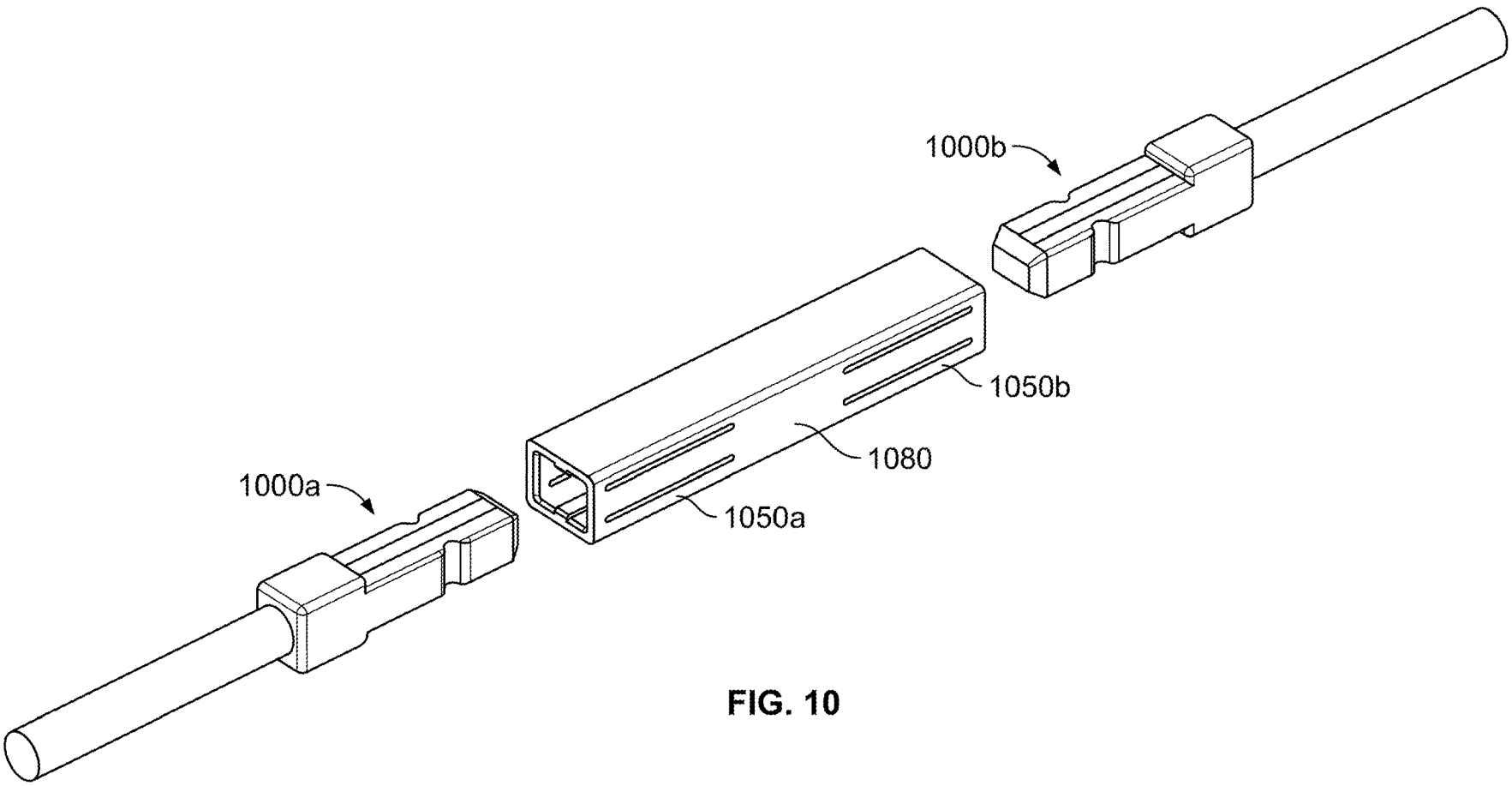
FIG. 10 is a perspective view of a pair of receptacles configured as a coupler.

FIG. 10 illustrates an example embodiment wherein a first and second receptacle 1050*a*, 1050*b* are combined to form a coupler 1080. Each of the receptacles 1050*a*, 1050*b* of the coupler 1080 is configured to receive a plug 1000*a*, 1000*b*, respectively. Receptacles 1050*a*, 1050*b* are configured to not only be mechanically coupled, but electrically coupled as well enabling a continuous electrical connection between plug 1000*a* and plug 1000*b*. The coupler 1080 may incorporate any of the latching schemes described above with reference to a single receptacle.

Figure 11A:
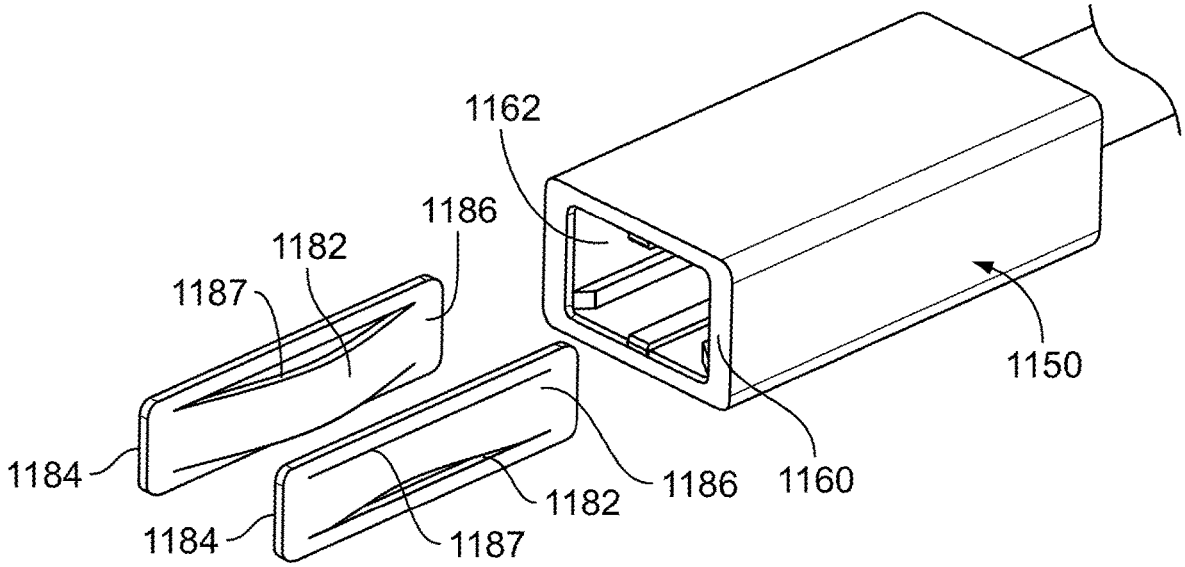
FIGS. 11A-11B provide a perspective view of a latching system of a plug and receptacle.
Figure 11B:
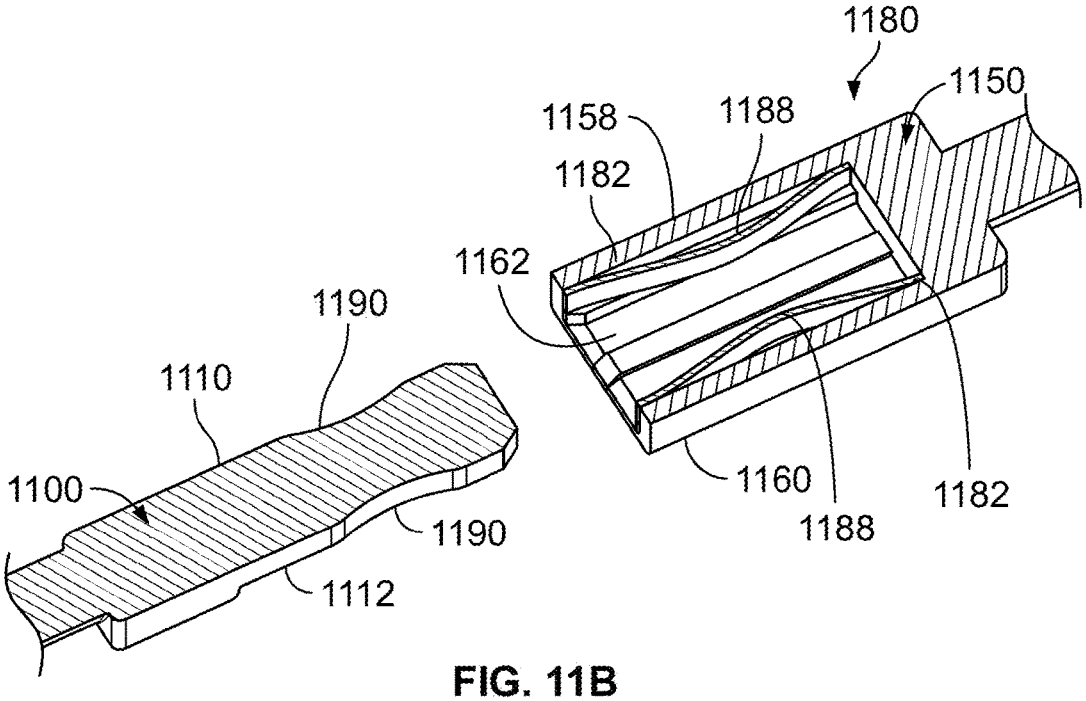

FIGS. 11A-11B illustrate further example embodiments wherein the receptacle 1150 incorporates a latching system 1180 that is distinct from the receptacle 1150 itself. The latching system 1180 of FIGS. 11A and 11B, includes a pair of fixed beams 1182 (in an alternative embodiment, a single fixed beam 1182 may be used) each of which are independent structures. Utilizing an independent structure provides for the ability to manufacture the receptacle 1150 and latching system 1180 from the same or different materials, e.g., materials with different mechanical properties. Each of the fixed beams 1182 has a first end 1184 and a second end 1186 supporting an elongate wall structure 1187 that is flexibly attached to the ends 1184, 1186; the elongate wall structure 1187 is configured to have maximum deflection at its center. The wall structure 1187 incorporates a rounded protrusion 1188 at its center. When the fixed beams 1182 are placed within an internal receiving cavity 1162 of the receptacle 1150 proximate side walls 1158 and 1160, the rounded protrusion 1188 extends further into the receiving cavity 1162 and operates as a latch retaining feature.

The latching system 1180 is configured to operate in conjunction with a plug 1100 having first and second side walls 1110, 1112 each of which incorporate a receiving cavity 1190. In the embodiment of FIGS. 11A and 11B, each of the receiving cavities 1190 spans the full height of the side walls 1110, 1112. Alternatively, for example, each of the receiving cavities 1190 may span only a portion of the height of the side walls 1110, 1112. Each of the receiving cavities 1190 is configured to mechanically interface with the latch retaining features, e.g., the rounded protrusions 1188 of the fixed beams 1182 within the receptacle 1150. When the plug 1100 is inserted into the receptacle 1150, with some insertion force, each of the fixed beams 1182 deflects outward, e.g., toward the side walls 1158 and 1160, until the plug 1100 is fully in position. Once the plug 1100 is in position, mechanical and electrical contact is established between strip contacts (not shown, see other example embodiments) of the plug 1100 and the receptacle 1150. Further, each of the deflected fixed beams 1182 is returned to its original, un-deflected position. Accordingly, a connected plug 1100 and receptacle 1150 requires a pull out force to separate and undo the internal latching that has occurred between the protrusions 1188 and the receiving cavities 1190.

Figure 12A:
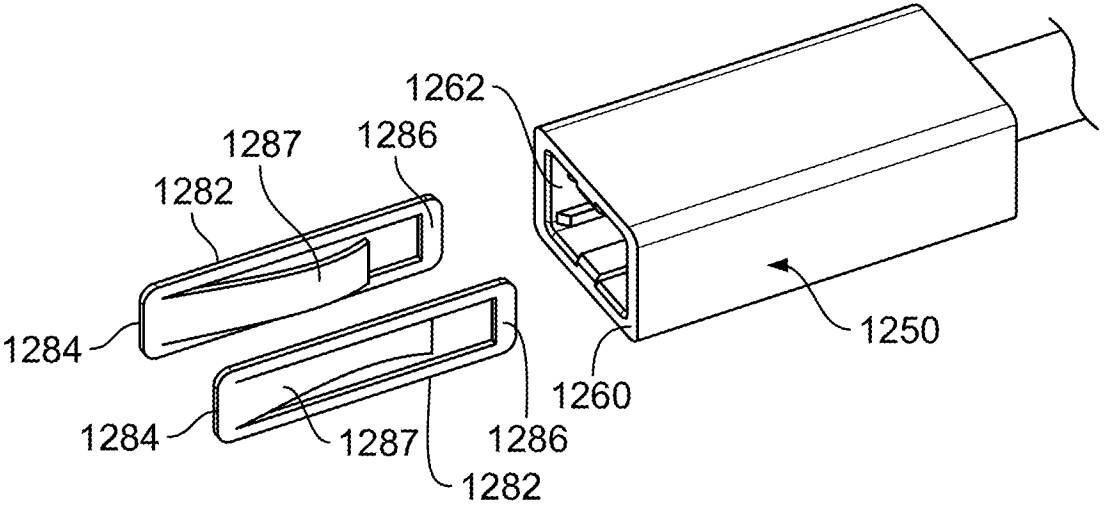
FIGS. 12A-12B provide a perspective view of a latching system of a plug and receptacle.
Figure 12B:
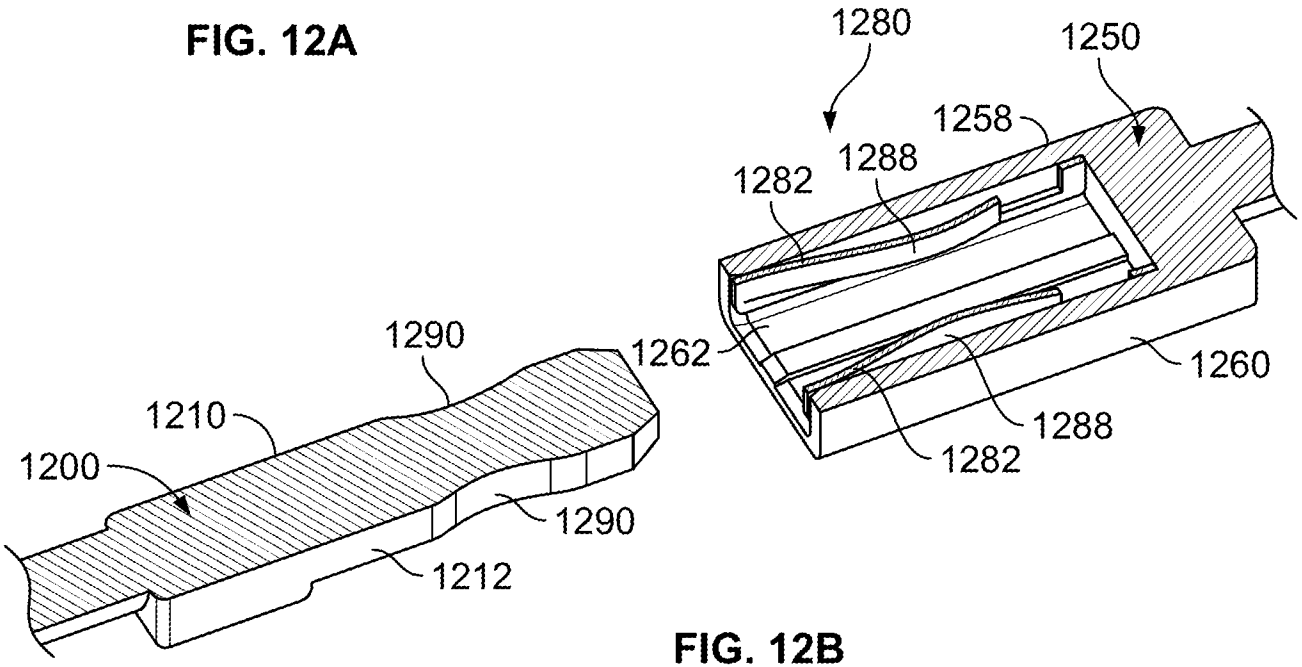

FIGS. 12A-12B illustrate another example embodiment wherein the receptacle 1250 incorporates a latching system 1280 that is distinct from the receptacle 1250 itself. The latching system 1280 of FIGS. 12A and 12B, includes a pair of cantilevered beams 1282 (in an alternative embodiment, a single cantilevered beam 1282 may be used) each of which are independent structures. Utilizing an independent structure provides for the ability to manufacture the receptacle 1250 and latching system 1280 from the same or different materials, e.g., materials with different mechanical properties. Each of the cantilevered beams 1282 comprises an elongate wall structure 1287 that is supported by a first end 1284 and unsupported by a second end 1286. Each of the cantilevered beams 1282 incorporates a rounded protrusion 1288 that is configured to operate as a latch retaining feature. Further, each of the cantilevered beams 1282 is configured to be placed within an internal receiving cavity 1262 of the plug 1250 proximate side walls 1258 and 1260, as shown.

In the latching system 1280, each of first and second side walls 1210, 1212 of a plug 1200 incorporates a receiving cavity 1290 that may span a portion or a full height of the side walls 1210, 1212. Each of the receiving cavities 1290 is configured to mechanically interface with the latch retaining feature, e.g., the rounded protrusion 1288, of the elongate wall structure 1287. When the plug 1200 is inserted into the receptacle 1250, with some insertion force, each of the cantilevered beams 1282 deflects outward, e.g., towards the side walls 1258, 1260, until the plug 1200 is fully in position. Once the plug 1200 is in position, mechanical and electrical contact is established between strip contacts (not shown, see other example embodiments) of the plug 1200 and the receptacle 1250. Further, each of the deflected cantilevered beams 1182 is returned to its original, undeflected position. Accordingly, a connected plug 1200 and receptacle 1250 requires a pull out force to separate and undo the internal latching that has occurred between the protrusions 1288 and the receiving cavities 1290.

In reference to the various plug and receptacle embodiments above, each may be used in various configurations such as plug-to-cable or plug-with-device (e.g. a PoE device), and receptacle/jack-to-cable or receptacle-to-PCB connectivity network system for applications such as unshielded and shielded communication networks, PoE communication networks, or DC power only networks (e.g., LED lighting systems). Further, a one-pair gigabit Ethernet connectivity network system including the plug and receptacle embodiments described above can have an overlay of intelligent connectivity management for the physical layer of the network (e.g., CPID, RFID, $9^{th}$ wire, and ImVision) to identify and detect the presence of a plug inserted into a mating receptacle/jack and to maintain accurate connectivity records (monitor and document).

Further the various plug and receptacle embodiments described herein are particularly suited to interfacing with the electrical and/or communication networks, or infrastructure, of a building, e.g. home, office building, commercial building, industrial building, etc. In this context, the plug and/or receptacles can be wall-, ceiling-, or floor-mounted, e.g., through use of a face plate or outlet box, or can be device mounted provide power, data, or both power and data to the device.

It should be noted that the above described embodiments are exemplary providing reference to upper and lower surfaces, first and second sides, forward and rearward ends, etc. however, any orientation of surfaces or sides, e.g., upper/lower, lower/upper, left/right, right/left, first/second, second/first, opposing, etc., is considered to be included in the disclosure.

Systems, devices or methods disclosed herein may include one or more of the features structures, methods, or combination thereof described herein. For example, a device or method may be implemented to include one or more of the features and/or processes above. It is intended that such device or method need not include all of the features and/or processes described herein, but may be implemented to include selected features and/or processes that provide useful structures and/or functionality.

Various modifications and additions can be made to the disclosed embodiments discussed above. Accordingly, the scope of the present disclosure should not be limited by the particular embodiments described above, but should be defined only by the claims set forth below and equivalents thereof.

What is claimed is:

1. A plug comprising:

a body portion having a length, an upper surface, and a lower surface; and only two electrical contacts that comprise a first electrical strip contact and a second electrical strip contact, wherein the first electrical strip contact is proximate the upper surface and has a length substantially equal to or less than the length of the body portion wherein the second electrical strip contact is proximate the lower surface and has a length substantially equal to or less than the length of the body portion;

wherein the only two electrical contacts transmit both power and data;

wherein the first and second electrical strip contacts are coupleable to one of:

a cable having a plurality of conductors, wherein only two of the plurality of conductors are used for the transmission of both power and data, and wherein one of the only two of the plurality of conductors is coupleable to the first electrical strip contact and wherein the other of the only two of the plurality of conductors is coupleable to the second electrical strip contact or a device having a plurality of contacts, wherein only two of the plurality of contacts are used for delivery of power and data to the device, and wherein one of the only two of the plurality of contacts is coupleable to the first electrical strip contact and wherein the other of the only two of the plurality of contacts is coupleable to the second electrical strip contact; and wherein the cable comprises a power over Ethernet (PoE) cable and wherein the two conductors comprise a twisted pair of wires.

2. The plug of claim 1, further comprising a base portion proximate the body portion, the base portion having a larger perimeter than a perimeter of the body portion.

3. The plug of claim 1, wherein the device comprises a LED light bulb, a room application sensor, a temperature sensor, a humidity sensor, a photodetector, a machine application sensor, a flow sensor, a pressure sensor, a vibration sensor, a force sensor, or a camera.

4. A system comprising;

a plug comprising:

a body portion having a length, an upper surface, and a lower surface; and only two electrical contacts that comprise a first electrical strip contact and a second electrical strip contact, wherein the first electrical strip contact is proximate the upper surface and has a length substantially equal to or less than the length of the body portion, wherein the second electrical strip contact is proximate the lower surface and has a length substantially equal to or less than the length of the body portion; and a receptacle comprising a housing having an interior receiving cavity, wherein the interior receiving cavity is configured to receive the plug and wherein the interior receiving cavity is defined by a length, an upper surface, and a lower surface; and only two electrical strip contacts, wherein the first electrical strip contact is proximate the upper surface and has a length substantially equal to or less than the length of the interior receiving cavity; and wherein the second electrical strip contact is proximate the lower surface and has a length substantially equal to or less than the length of the interior receiving cavity; and wherein upon insertion of the plug into the interior receiving cavity, the first electrical strip contact of the plug is electrically coupled to the first electrical strip contact of the interior receiving cavity and the second electrical strip contact of the plug is electrically coupled to the second electrical strip contact of the interior receiving cavity.

5. The system of claim 4, wherein the body portion of the plug includes a receiving cavity.

6. The system of claim 5, wherein the receiving cavity extends a full height of the body portion.

7. The system of claim 5, wherein the housing of the receptacle includes a latch retaining feature configured to interface with the receiving cavity of the body portion of the plug.

8. The system of claim 7, wherein the latch retaining feature comprises a deflectable beam having a first end and a second end, wherein each end is fixed within the housing of the receptacle, the deflectable beam having a protrusion thereon to interface with the receiving cavity of the plug.

9. The system of claim 7, wherein the latch retaining feature comprises a deflectable cantilevered beam having a first end and a second end, wherein the first end is fixed within the housing of the receptacle and the second end is unfixed, the deflectable cantilevered beam having a protrusion thereon to interface with the receiving cavity of the plug.

10. The system of claim 7, wherein the latch retaining feature comprises a deflectable, spring-loaded plunger, wherein the spring-loaded plunger includes a first portion that is retained within a wall of the interior receiving cavity of the receptacle and a second portion that protrudes into the interior receiving cavity, the second portion configured to interface with the receiving cavity of the plug.

11. The system of claim 10, wherein the second portion of the deflectable, spring-loaded plunger has a height substantially equivalent to a full height of the body portion of the plug.

12. The system of claim 7, wherein the latch retaining feature is configured to removably retain the plug within the receptacle.

13. The system of claim 4, wherein the receptacle is configured to be electrically coupled to a printed circuit board.

14. The system of claim 4, further comprising a plurality of receptacles, wherein the plurality of receptacles are combined into a row, column or array configuration.

15. The system of claim 4, wherein the first and second electrical strip contacts of the receptacle are configured to be electrically coupled to one of:

a cable having a plurality of conductors, wherein only two of the plurality of conductors are used for the transmission of both power and data, and wherein one of the only two of the plurality of conductors is coupleable to the first electrical strip contact of the receptacle and wherein the other of the only two of the plurality of conductors is coupleable to the second electrical strip contact of the receptacle; or a device having a plurality of contacts, wherein only two of the plurality of contacts are used for delivery of power and data to the device, and wherein one of the only two of the plurality of contacts is coupleable to the first electrical strip contact of the receptacle and wherein the other of the only two of the plurality of contacts is coupleable to the second electrical strip contact of the receptacle.

16. The system of claim 15, wherein the cable comprises a power over Ethernet (PoE) cable and wherein the plurality of conductors comprise a twisted pair of wires.

17. The system of claim 4, further comprising a first sealing device and a second sealing device proximate a first end and a second end of the receptacle, the first and second sealing devices configured to prevent environmental contaminants from entering the receptacle.

18. The system of claim 4, further comprising a pair of plugs and a pair of receptacles, wherein each of the pair of receptacles is configured to receive one of the pair of plugs, and wherein the pair of receptacles are configured in a coupling configuration to maintain electrical continuity between the pair of plugs when the plugs are inserted within the receptacles.

* * * * *